US010224658B2

(12) United States Patent
Marsh et al.

(10) Patent No.: US 10,224,658 B2
(45) Date of Patent: Mar. 5, 2019

(54) ELECTRICAL CONTACT DEVICE

(71) Applicants: Tyco Electronics UK Ltd, Swindon (GB); TE Connectivity Germany GmbH, Bensheim (DE)

(72) Inventors: John Marsh, London (GB); Ruediger Meier, Neckargemuend (DE); Jochen Fertig, Bensheim (DE); Holger Stange, Frankenthal (DE)

(73) Assignees: Tyco Electronics UK Ltd, Swindon (GB); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/660,090

(22) Filed: Jul. 26, 2017

(65) Prior Publication Data

US 2017/0324183 A1 Nov. 9, 2017

Related U.S. Application Data

(63) Continuation of application No. PCT/EP2016/051969, filed on Jan. 29, 2016.

(30) Foreign Application Priority Data

Jan. 30, 2015 (DE) ..... 10 2015 201 694

(51) Int. Cl.

| | |
|---|---|
| ***H01R 13/11*** | (2006.01) |
| ***H01R 13/426*** | (2006.01) |
| *H01R 4/18* | (2006.01) |
| *H01R 13/187* | (2006.01) |

(52) U.S. Cl.

CPC ..... *H01R 13/113* (2013.01); *H01R 13/426* (2013.01); *H01R 4/185* (2013.01); *H01R 13/187* (2013.01)

(58) Field of Classification Search

CPC ..... H01R 13/187; H01R 13/113
USPC ..... 439/224
See application file for complete search history.

(56) References Cited

U.S. PATENT DOCUMENTS

| | | | | |
|---|---|---|---|---|
| 5,588,884 | A * | 12/1996 | Rudoy | H01R 13/187 439/787 |
| 6,692,316 | B2 * | 2/2004 | Hsieh | H01R 13/187 439/224 |
| 7,241,189 | B2 | 7/2007 | Mohs et al. | |
| 7,601,019 | B2 * | 10/2009 | Hsieh | H01R 13/426 439/345 |
| 9,142,901 | B2 | 9/2015 | Ando et al. | |

(Continued)

FOREIGN PATENT DOCUMENTS

| | | | |
|---|---|---|---|
| CN | 101330177 | A | 12/2008 |
| EP | 2006958 | A2 | 12/2008 |

(Continued)

OTHER PUBLICATIONS

PCT Written Opinion of the International Searching Authority and International Search Report, dated Apr. 11, 2016, 11 pages.

(Continued)

*Primary Examiner* — Ross N Gushi
(74) *Attorney, Agent, or Firm* — Barley Snyder

(57) ABSTRACT

An electrical contact device comprises a contact body and a mating contact receiver. The mating contact receiver is mountable on the contact body in at least two positions and receives a mating contact device along two different axes.

20 Claims, 6 Drawing Sheets

(56) References Cited

U.S. PATENT DOCUMENTS

| | | | |
|---|---|---|---|
| 2007/0066152 | A1 | 3/2007 | Mohs et al. |
| 2008/0293287 | A1 | 11/2008 | Zinn |
| 2008/0318460 | A1 | 12/2008 | Hsieh et al. |
| 2014/0106627 | A1 | 4/2014 | Hoffman |

FOREIGN PATENT DOCUMENTS

| | | | |
|---|---|---|---|
| JP | 2005505104 | A | 2/2005 |
| JP | 2007531224 | A | 11/2007 |
| JP | 2009004379 | A | 1/2009 |
| JP | 2013004453 | A | 1/2013 |
| WO | 2012176395 | A1 | 12/2012 |

OTHER PUBLICATIONS

Japanese Notice of Reasons for Refusal and English translation, dated Apr. 19, 2018, 8 pages.
Chinese First Office Action and English translation, dated Aug. 2, 2018, 19 pages.

* cited by examiner

ELECTRICAL CONTACT DEVICE

CROSS-REFERENCE TO RELATED APPLICATIONS

This application is a continuation of PCT International Application No. PCT/EP2016/051969, filed on Jan. 29, 2016, which claims priority under 35 U.S.C. § 119 to German Patent Application No. 102015201694.3, filed on Jan. 30, 2015.

FIELD OF THE INVENTION

The present invention relates to an electrical contact device and, more particularly, to an electrical contact device having a contact body and a mating contact receiver.

BACKGROUND

In automotive applications, electrical connections must carry electrical currents, voltages and/or signals in heat-stressed, dirty, moist and/or chemically aggressive environments. The electrical connections may be required to carry the currents, voltages, and/or signals for a short time, sometimes after a relatively long period, or on an ongoing basis. Given the broad range of applications for electrical connections of this kind, a large number of electrical contacts or contact devices are known which are constructed to serve specific applications.

Such a contact device, for example a crimp contact device of a plug connector, is crimped to an electrical cable. In addition to creating a permanent electrical connection, a contact device must also create a permanent mechanical connection between the cable and a crimping region of the crimp contact device. Known contact devices, however, are complexly constructed for each specific application and can only be inserted from one direction to form an electrical connection particular to that application.

SUMMARY

An electrical contact device according to the invention comprises a contact body and a mating contact receiver. The mating contact receiver is mountable on the contact body in at least two positions and receives a mating contact device along two different axes.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
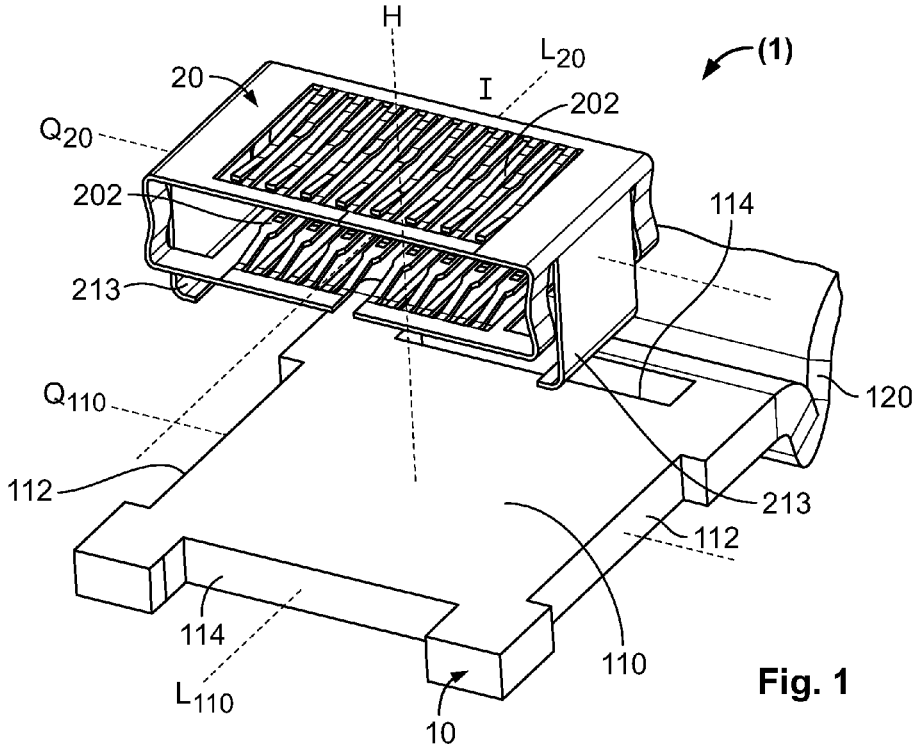
FIG. 1 is a perspective view of a contact device according to the invention prior to mounting with a mating contact receiver of the contact device in a first position with respect to a contact body of the contact device.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

An electrical contact device 1 according to an embodiment of the invention is shown in FIGS. 1-10. In the shown embodiment, the contact device 1 is a socket crimp contact device, but the contact device 1 may be any other type of contact device known to those with ordinary skill in the art. The contact device 1 has a contact body 10 and a mating contact receiver 20 disposed on the contact body 10. The major components of the invention will now be described in greater detail.

Figure 8:
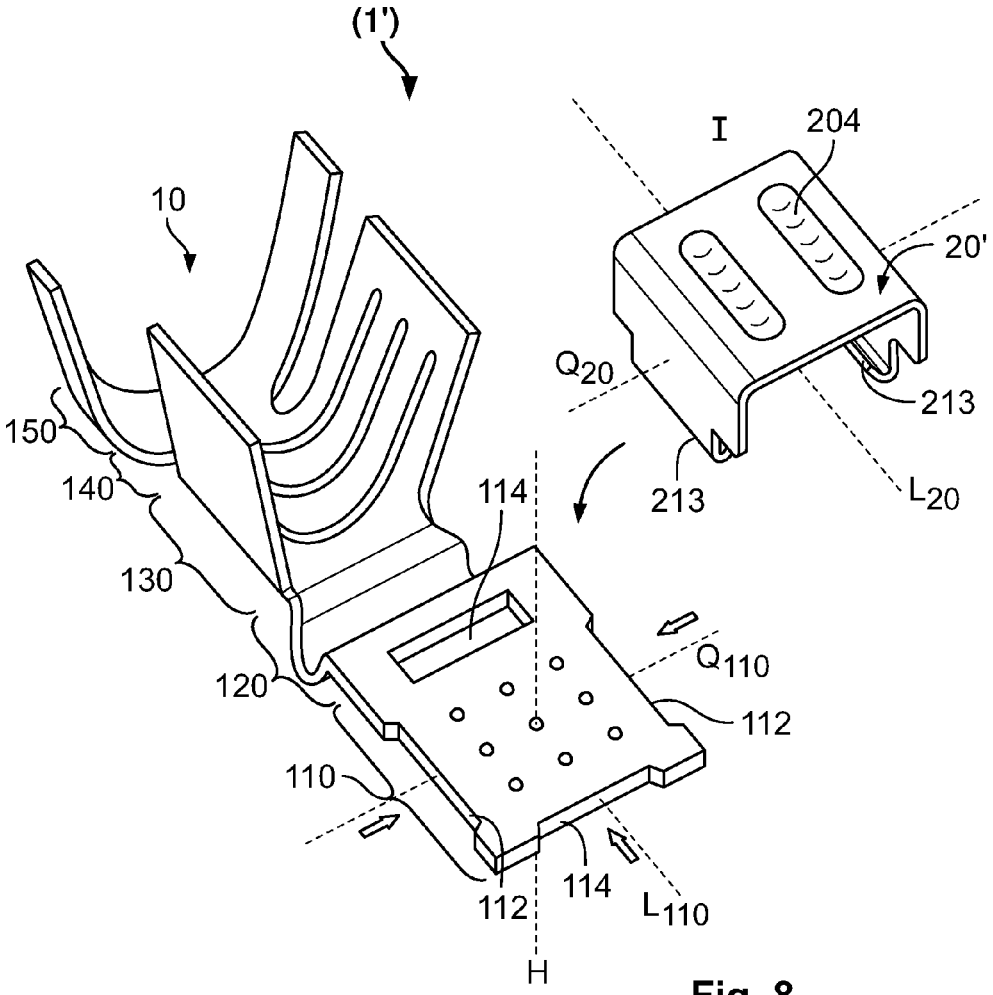
FIG. 8 is a perspective view of a contact device according to another embodiment of the invention with a mating contact receiver in a first position with respect to a contact body.

The contact body 10, as shown in FIGS. 1 and 8, has a contact region 110, a conductor crimping region 130, and an insulation crimping region 150. The contact region 110, as shown in FIG. 1, has a longitudinal axis L110 and a transverse axis Q110. The contact region 110 is symmetrical about the longitudinal axis L110 and the transverse axis Q110. A first transition region 120 is disposed between the contact region 110 and the conductor crimping region 130. The first transition region 120 is curved in relation to the longitudinal axis L110 of the contact region 110. A second transition region 140 is disposed between the conductor crimping region 130 and the insulation crimping region 150. In the shown embodiment, the contact body 10 is monolithically formed from a metal or a metal alloy.

The mating contact receiver 20, as shown in FIG. 1, has a rectangular cross-section and is substantially closed around its periphery. The mating contact receiver 20 has a plurality of contact springs 202 disposed on an inside of the mating contact receiver 20 opposite one another and projecting within the mating contact receiver 20. The contact springs 202 extend along a longitudinal axis L20 of the mating contact receiver 20. The mating contact receiver 20 is symmetrical about the longitudinal axis L20 and a transverse axis Q20. In the shown embodiment, the mating contact receiver 20 is monolithically formed from a metal, a metal alloy, or a plastic.

The mating contact receiver 20 may be mounted on the contact region 110 of the contact body in a first mounting position I or a second mounting position II. The first mounting position I is shown in FIGS. 1, 3, 5, 8 and 9. The second mounting position II is shown in FIGS. 2, 4, 6 and 7. The first mounting position I and the second mounting position II vary by a rotation of the mating contact receiver 20 about an axis of rotation H extending through a center of the contact region 110.

In the first mounting position I of the mating contact receiver 20 on the contact body 10, as shown in FIGS. 1, 3, 5, 8, and 9, the longitudinal axis L110 of the contact region 10 is arranged substantially parallel to the longitudinal axis L20 of the mating contact receiver 20; an angle between the axes L110 and L20 is approximately 0°. The mating contact receiver 20, due to the symmetry of the axes, may have the longitudinal axis L20 disposed 0° or 180° with respect to the longitudinal axis L110 in the first mounting position I. In other embodiments, the longitudinal axis L110 and the longitudinal axis L20 may form a small angle with respect to one another in the first position I between 0° and 30°.

In the second mounting position II of the mating contact receiver 20 on the contact body 10, as shown in FIGS. 2, 4, 6, and 7, the longitudinal axis L110 of the contact region 110 is arranged substantially perpendicular to the longitudinal axis L20 of the mating contact receiver 20; an angle between the axes L110 and L20 is approximately 90°. The mating contact receiver 20, due to the symmetry of the axes, may have the longitudinal axis L20 disposed 90° or 270° with respect to the longitudinal axis L110 in the second mounting position II. In other embodiments, the longitudinal axis L110 and the longitudinal axis L20 may form a large angle with respect to one another in the second mounting position II between 60° and 90°.

Figure 2:
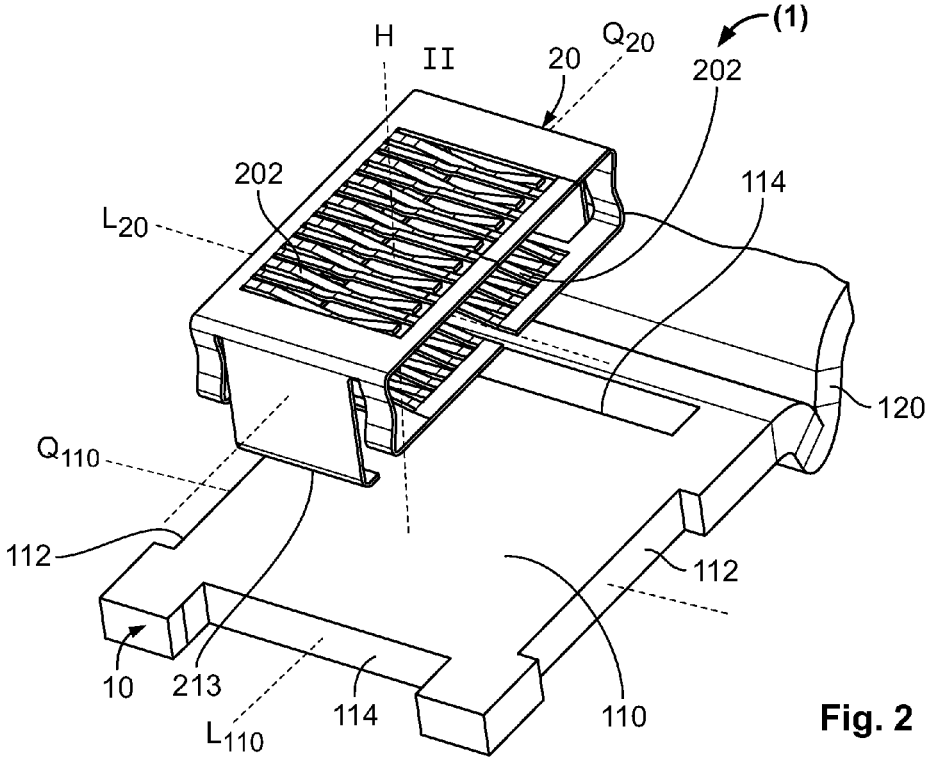
FIG. 2 is a perspective view of the contact device prior to mounting with the mating contact receiver in a second position with respect to the contact body.

The mating contact receiver 20 and the contact region 110 of the contact body 10 are shown prior to mounting in FIGS. 1 and 2. The mating contact receiver 20 is then moved toward the contact region 110, as shown in FIGS. 3 and 4, and mounted on the contact region 110.

Figure 3:
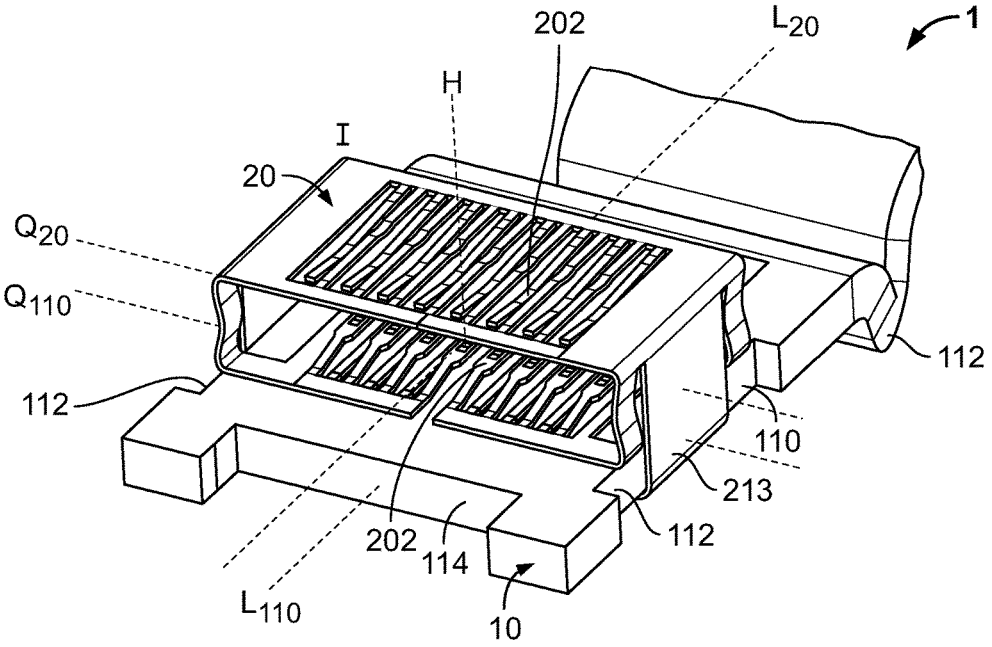
FIG. 3 is a perspective view of the mating contact receiver mounted on the contact body in the first position.
Figure 4:
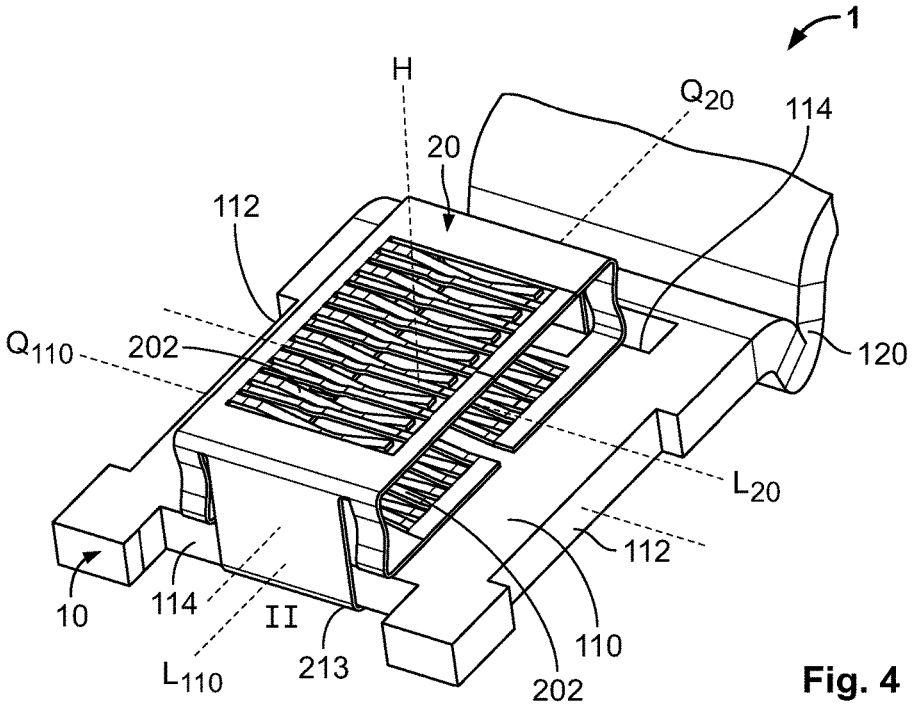
FIG. 4 is a perspective view of the mating contact receiver mounted on the contact body in the second position.

As shown in FIGS. 3 and 4, the contact region 110 has a pair of first edges 112 opposite one another and a pair of second edges 114 opposite one another. A distance between the pair of first edges 112 in a transverse direction Q of the contact region 110 is equal to a distance between the pair of second edges 114 in a longitudinal direction L of the contact region 110. A pair of latching hooks 213 of the mating contact receiver 20 engages the pair of first edges 112 in the first mounting position I shown in FIG. 3 and engages the pair of second edges 114 in the second mounting position II shown in FIG. 4 to secure the mating contact receiver 20 to the contact body 10. The latching hooks 213, as shown in FIGS. 1-4, extend downwards and laterally away from a top of the mating contact receiver 20. The first edges 112 and second edges 114 are laterally delimited by a projection so that the mating contact receiver 20 cannot slip off the contact region 110. In the shown embodiment, one of the second edges 114 is formed by an aperture extending through the contact region 110.

Figure 5:
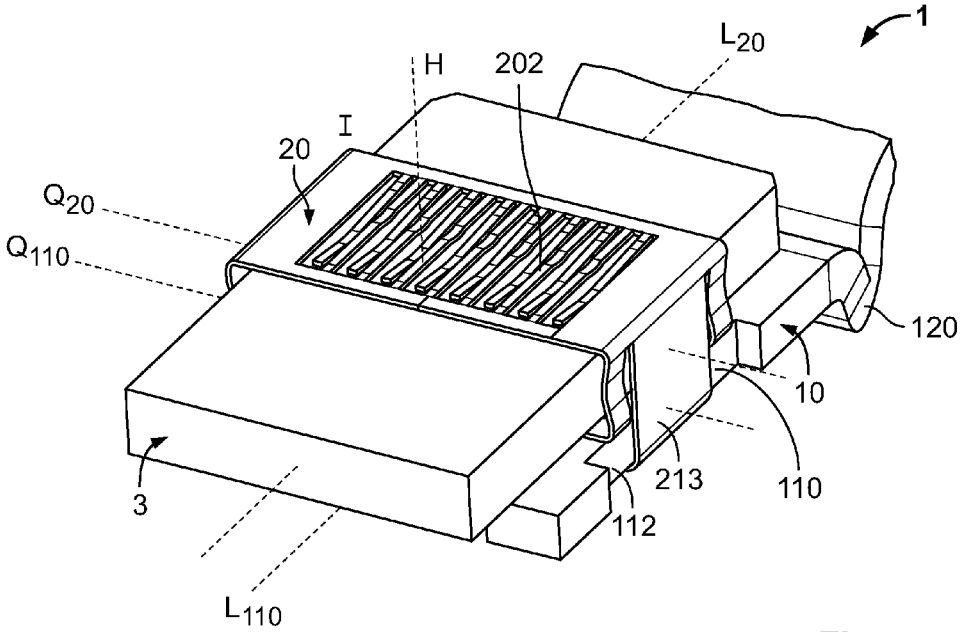
FIG. 5 is a perspective view of the mating contact receiver mounted on the contact body in the first position and a mating contact device.
Figure 6:
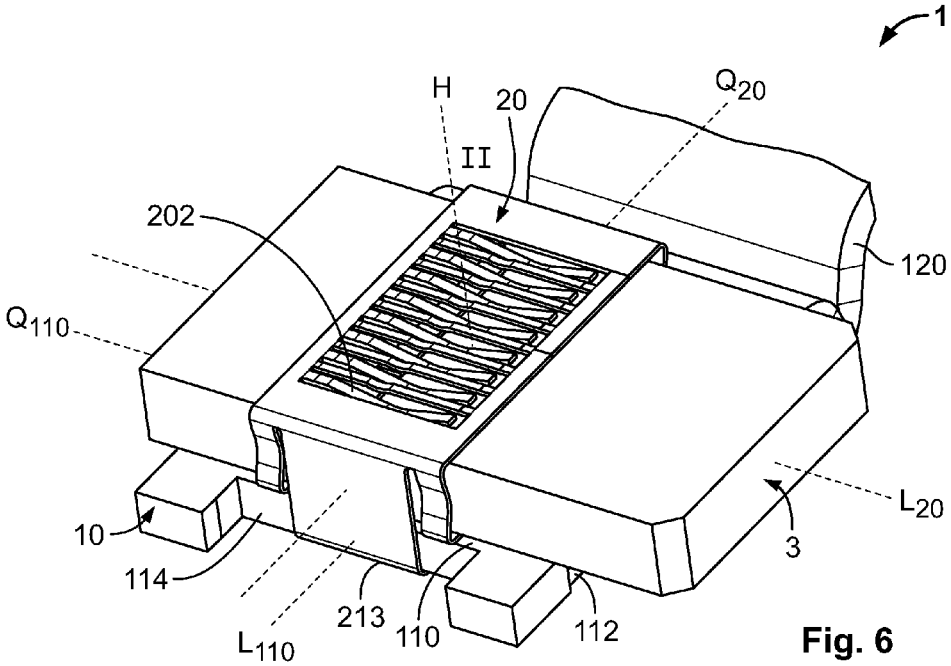
FIG. 6 is a perspective view of the mating contact receiver mounted on the contact body in the second position and a mating contact device.
Figure 7:
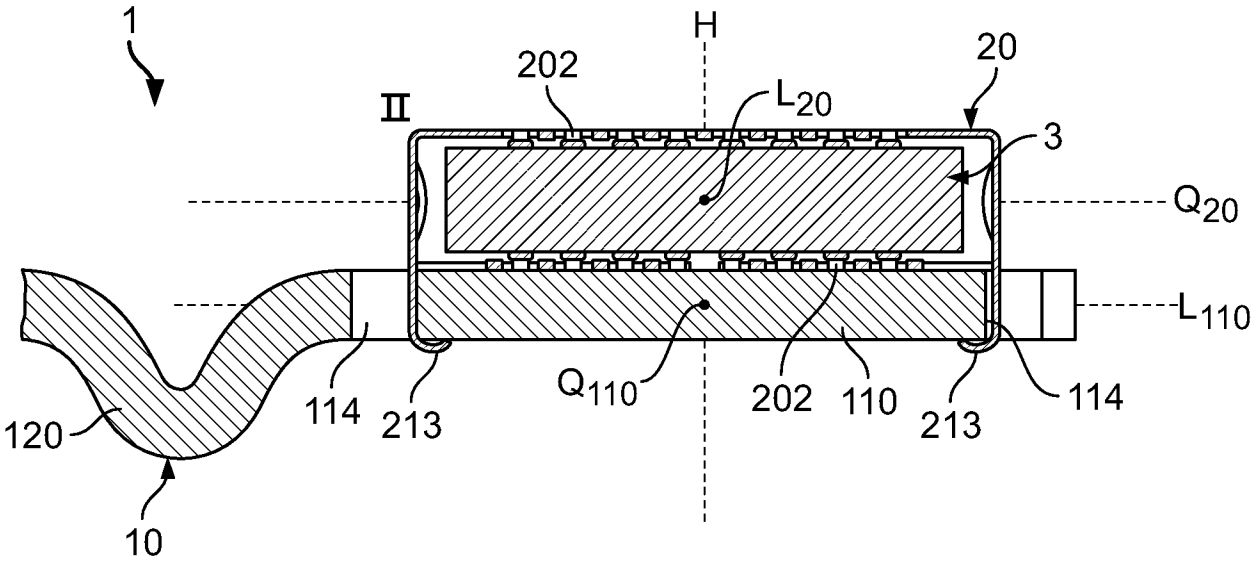
FIG. 7 is a sectional view of the mating contact receiver mounted on the contact body in the second position and the mating contact device.

The contact device 1, as shown in FIGS. 5-7, receives a mating contact device 3. In the shown embodiment, the mating contact device 3 is a tab or pin. The mating contact device 3 is inserted into the mating contact receiver 20 and is entirely and form-fittingly received in the mating contact receiver 20. In the first mounting position I shown in FIG. 5, the mating contact device 3 is inserted into the contact device 1 along the longitudinal axis L110. In the second mounting position II shown in FIGS. 6 and 7, the mating contact device 3 is inserted into the contact device 1 along the transverse axis Q110. The mating contact device 3 makes electrical contact with the contact springs 202 projecting within the mating contact receiver 20 to form an electrical connection between the mating contact device 3 and the contact device 1.

Figure 9:
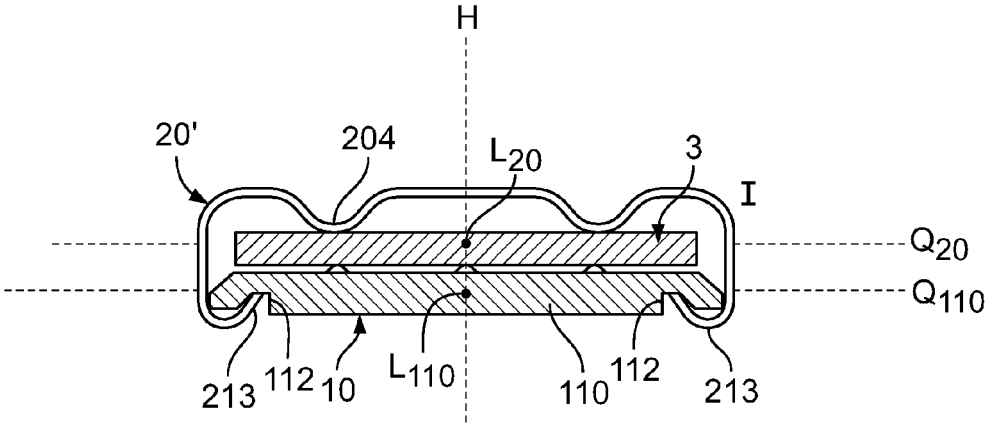
FIG. 9 is a sectional view of the contact device of FIG. 8.

A contact device 1' according to another embodiment of the invention is shown in FIGS. 8 and 9. The contact device 1' has a contact body 10 identical to that of the contact device 1. The mating contact receiver 20' of the contact device 1', in contrast to the mating contact receiver 20 of the contact device 1, is open at a side of its periphery and has a cross-section formed in a U-shape. The mating contact device 3 is form-fit between the mating contact receiver 20' and the contact region 110.

The mating contact receiver 20', as shown in FIGS. 8 and 9, is symmetrical about its longitudinal axis L20 and its transverse axis Q20 such that once again a 0° first mounting position I is substantially indistinguishable from a 180° first mounting position I, and a 90° second mounting position II is substantially indistinguishable from a 270° second mounting position II of the mating contact receiver 20' on the contact region 110. The mating contact receiver 20' has, for the mating contact device 3 to make electrical contact, at least one contact bead 204 projecting within the mating contact receiver 20'. In the shown embodiment, a pair of contact beads 204 extends in the longitudinal direction L20 of the mating contact receiver 20' and is disposed within the mating contact receiver 20'.

Figure 10:
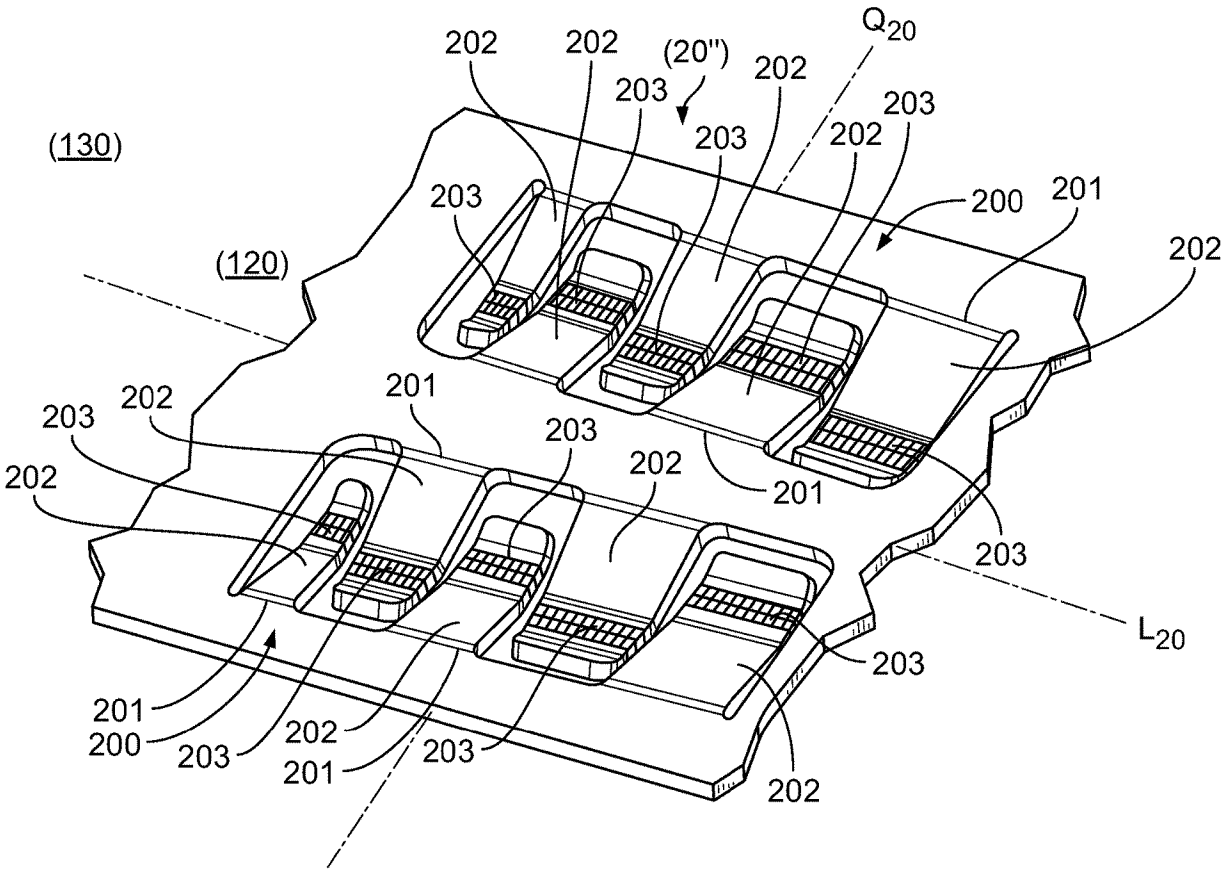
FIG. 10 is a perspective view of an electrical connection region of a mating contact receiver.

An electrical connection region 20 of a mating contact receiver 20" according to another embodiment of the invention is shown in FIG. 10. The connection region 200 is divided into two portions each having a plurality of electrical contact springs 202. In the shown embodiment, five contact springs 202 are installed in each portion in the mating contact receiver 20". It is of course possible for the connection region 200 to include only one or a number of portions greater than two, and more or fewer than five contact springs 202 may of course be provided. An embodiment of this kind is applicable to all the embodiments of the invention. Each contact spring 202, as shown in FIG. 10, extends along the transverse axis Q20 and is attached to the mating contact receiver 20" at an attachment region 201 on one end. In an embodiment, the contact springs 202 are monolithically formed with the mating contact receiver 20".

So that rigidity of the connection region 200 is not weakened by the stamped-out contact springs 202, the attachment regions 201 of the contact springs 202 are arranged alternately opposite one another, as shown in FIG. 10. In the longitudinal direction L20 of the mating contact receiver 20", a first contact spring 202 is attached to the mating contact receiver 20" on the right or left, and the directly adjacent second contact spring 202 in this longitudinal direction L20 is then attached to the mating contact receiver 20" on the left or right. The opposite contact springs 202 are disposed between one another.

As shown in FIG. 10, the contact springs 202 are not formed identically so as to create a more even distribution of electrical current. The contact springs 202 are constructed and installed in the mating contact receiver 20" such that through them, for at least one mounting position I/II of the mating contact receiver 20" on the contact device 10, there is no substantially or primarily preferred path for the electrical current through the contact springs 202. In a portion of the connection region 200 there are contact springs 202 having a smaller width in the longitudinal direction L20, which are disposed in the vicinity of the conductor crimping region 130 of the contact body 10, and there are contact springs 202 having a greater width in the longitudinal direction L20, which are disposed further away from the conductor crimping region 130. Electrical contact regions 203 of the contact springs 202 are wider the further away they are from the conductor crimping region 130. Since the contact springs 202 having a smaller width have a greater electrical resistance, these contact springs 202 are disposed to ensure that an electrical current flowing through the mating contact device 3, the mating contact receiver 20", and the contact body 10 has a same electrical resistance through all the contact springs 202. Further, contact springs 202 having a greater width have greater normal forces of contact, and their lengths may be increased in order to generate normal forces of contact that are constant through substantially all the contact springs 202. As shown in FIG. 10, the widths of the contact springs 202 of the mating contact receiver 20" increase continuously from the terminal connection region 130 of the contact body 10 in the longitudinal direction L20 of the mating contact receiver 20". Further, the lengths of the contact springs 202 of the mating contact receiver 20" increase continuously from the terminal connection region 130 of the contact body 10 in the longitudinal direction L20 of the mating contact receiver 20".

What is claimed is:

1. An electrical contact device, comprising:

a contact body; and a mating contact receiver mountable on the contact body in at least two positions and receiving a mating contact device along a first axis in a first position of the at least two positions and along a second axis different from the first axis in a second position of the at least two positions, the mating contact receiver has a plurality of contact springs each having a different width, the contact springs adjacent a conductor crimping region of the contact body have a smaller width than the contact springs further from the conductor crimping region.

2. The electrical contact device of claim 1, wherein the at least two positions vary by a rotation of the mating contact receiver about an axis of rotation extending through a center of a contact region of the contact body.

3. The electrical contact device of claim 2, wherein the mating contact receiver is mounted on the contact region such that an angle between a longitudinal axis of the mating contact receiver and a longitudinal axis of the contact region is one of 0°, 90°, 180°, and 270°.

4. The electrical contact device according to claim 1, wherein the mating contact receiver is mounted on a contact region of the contact body in a first position in which a longitudinal axis of the mating contact receiver is substantially parallel to a longitudinal axis of the contact region or in a second position in which the longitudinal axis of the mating contact receiver is substantially perpendicular to the longitudinal axis of the contact region.

5. The electrical contact device of claim 4, wherein the mating contact receiver has a pair of latching hooks.

6. The electrical contact device of claim 5, wherein the contact region has a pair of first edges and a pair of second edges, the pair of latching hooks engaging the pair of first edges in the first position and engaging the pair of second edges in the second position.

7. The electrical contact device of claim 6, wherein a distance between the pair of first edges in a transverse direction of the contact region is equal to a distance between the pair of second edges in a longitudinal direction of the contact region.

8. The electrical contact device of claim 1, wherein the mating contact receiver has a rectangular cross-section and is substantially closed around a peripheral direction of the mating contact receiver, the mating contact device being entirely received in the mating contact receiver.

9. The electrical contact device of claim 8, wherein each of the contact springs is disposed on an inside of the mating contact receiver and projects within the mating contact receiver.

10. The electrical contact device of claim 2, wherein the mating contact receiver has a U-shaped cross-section and is open at a side in a peripheral direction of the mating contact receiver, the mating contact device being received between the mating contact receiver and the contact region.

11. The electrical contact device of claim 10, wherein the mating contact receiver has a contact bead disposed on an inside of the mating contact receiver and projecting within the mating contact receiver.

12. The electrical contact device of claim 1, wherein each of the contact springs has an electrical contact region, the contact springs each having a different length between an attachment region of the contact spring connected to the mating contact receiver and the electrical contact region.

13. The electrical contact device of claim 12, wherein the contact springs adjacent the conductor crimping region of the contact body have a smaller length between the attachment region and the electrical contact region than that of the contact springs further from the conductor crimping region.

14. The electrical contact device of claim 1, wherein the contact body is monolithically formed from a metal material.

15. The electrical contact device of claim 1, wherein the mating contact receiver is monolithically formed from a metal or a plastic material.

16. A method for forming an electrical contact device, comprising:

providing a contact body; and mounting a mating contact receiver on the contact body in one of at least two positions, the mating contact receiver receiving a mating contact device along a first axis in a first position of the at least two positions and along a second axis different from the first axis in a second position of the at least two positions, the mating contact receiver has a plurality of contact springs each having a different width, the contact springs adjacent a conductor crimping region of the contact body have a smaller width than the contact springs further from the conductor crimping region.

17. The method of claim 16, wherein the mating contact receiver is mounted on a contact region of the contact body such that an angle between a longitudinal axis of the mating contact receiver and a longitudinal axis of the contact region is one of 0°, 90°, 180°, and 270°.

18. The method of claim 17, wherein the mating contact receiver is latched onto the contact body.

19. An electrical contact device, comprising:

a contact body; and a mating contact receiver mountable on the contact body in at least two positions and receiving a mating contact device along a first axis in a first position of the at least two positions and along a second axis different from the first axis in a second position of the at least two positions, the mating contact receiver has a plurality of contact springs each having a different width and each of the contact springs has an electrical contact region, the contact springs each have a different length between an attachment region of the contact spring connected to the mating contact receiver and the electrical contact region.

20. The electrical contact device of claim 19, wherein the contact springs adjacent a conductor crimping region of the contact body have a smaller length between the attachment region and the electrical contact region than that of the contact springs further from the conductor crimping region.

* * * * *